US007337493B2

(12) United States Patent
Ueyama et al.

(10) Patent No.: US 7,337,493 B2
(45) Date of Patent: Mar. 4, 2008

(54) UPRIGHT-TYPE ELECTRIC VACUUM CLEANER WITH DETACHABLE DUST COLLECTOR

(75) Inventors: Shuzo Ueyama, Kasai (JP); Hidetoshi Fukuoka, Hyogo-ken (JP); Shinichi Hagino, Himeji (JP); Jun Yoshida, Himeji (JP); Yoshihiro Mori, Kasai (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 545 days.

(21) Appl. No.: 10/865,302

(22) Filed: Jun. 10, 2004

(65) Prior Publication Data

US 2004/0261215 A1 Dec. 30, 2004

(30) Foreign Application Priority Data

Jun. 16, 2003 (JP) ..... 2003-170776

(51) Int. Cl.
*A47L 9/16* (2006.01)
*A47L 5/14* (2006.01)

(52) U.S. Cl. ..... 15/352; 15/353; 15/346; 55/DIG. 3

(58) Field of Classification Search ..... 15/351, 15/352, 353; 55/DIG. 3
See application file for complete search history.

(56) References Cited

U.S. PATENT DOCUMENTS 5,867,863 A * 2/1999 McCormick ..... 15/351
6,588,051 B2 * 7/2003 Hashizume et al. ..... 15/323
7,152,275 B2 * 12/2006 Hitzelberger et al. ..... 15/352

FOREIGN PATENT DOCUMENTS

JP 2000-342492 12/2000

OTHER PUBLICATIONS

Patent Abstracts of Japan, Publication No. 2000-342492.

* cited by examiner

*Primary Examiner*—Theresa T Snider
(74) *Attorney, Agent, or Firm*—Ware, Fressola, Van Der Sluys & Adolphson

(57) ABSTRACT

An upright-type electric vacuum cleaner including a vacuum cleaner main body with at least a dust collector and an exhaust outlet, and a suction body provided at a lower front of the vacuum main body. The dust collector is disposed on a rearward side of the vacuum cleaner main body and wherein the exhaust outlet is disposed on a front surface side of the dust collector. The area of the exhaust outlet can be made large without being interfered by the dust collector.

7 Claims, 14 Drawing Sheets

UPRIGHT-TYPE ELECTRIC VACUUM CLEANER WITH DETACHABLE DUST COLLECTOR

BACKGROUND OF THE INVENTION

The present invention relates to an upright-type electric vacuum cleaner, and particularly to an upright-type electric vacuum cleaner which is so arranged that a suction body is disposed downward and that a vacuum cleaner main body including a dust collector and an exhaust outlet is disposed upward thereof.

This kind of upright-type electric vacuum cleaner is described, for example, in Japanese Unexamined Patent Publication No. 2000-342492. In such an upright-type electric vacuum cleaner, a vacuum cleaner main body is attached to a suction body in a freely tilting manner while a dust collector is provided above the vacuum cleaner main body. The dust collector was disposed at a front surface of the product while an exhaust outlet was provided downward of the dust collector.

However, it was the case with the above-described conventional upright-type electric vacuum cleaner that the dust collector occupied a large volume for securing a sufficient capacity for the dust collector. The area of the exhaust outlet could thus not be sufficiently secured so that the pressure loss in the exhaust passage became large which caused a decrease in suction performance.

SUMMARY OF THE INVENTION

The present invention has been made for solving such a problem, and it is an object thereof to provide an upright-type electric vacuum cleaner of improved suction performance by securing a large area for the exhaust outlet.

For solving this problem, an upright-type electric vacuum cleaner of the present invention is characterized in that it includes a vacuum cleaner main body including at least a dust collector and an exhaust outlet, and a suction body provided at a lower front of the vacuum main body. The dust collector is disposed on a rearward side of the vacuum cleaner main body and wherein the exhaust outlet is disposed on a front surface side of the dust collector.

With this arrangement, it is possible to secure a large area for the exhaust outlet while avoiding interference by the dust collector. It is consequently possible to reduce the air resistance of the exhaust passage and to improve the suction performance of the electric vacuum cleaner. Since the wind velocity of exhaustion through the exhaust outlet can be made small, occasion at which a person residing in the room will feel uncomfortable through exhaust wind or at which dust within the room is stirred up by the exhaust wind will be reduced.

In the vacuum cleaner main body, an exhaust filter might be provided inside of the exhaust outlet at a position at which it opposes the exhaust outlet.

With this arrangement, the area of the exhaust filter disposed at an inlet side of the exhaust outlet can be made large so that stains per each unit area of the exhaust filter can be reduced. The frequency of cleaning or exchanging the exhaust filter that the user of the electric vacuum cleaner needs to perform can be reduced.

It is also possible to attach a front cover to a front surface of the vacuum cleaner main body in a freely attachable and detachable manner, wherein an exhaust outlet is formed on the front cover, and wherein the exhaust filter might be attached such that it can be freely attached to or detached from the front surface when the front cover is detached.

In this manner, detaching the exhaust filter for cleaning and exchanging operations thereof can be easily performed.

It is also possible to dispose the dust collector on a rear side of an operating handle attached to an upper portion of the vacuum cleaner main body and also in a freely attachable and detachable manner to and from the vacuum cleaner main body.

With this arrangement, it will be easy to check the amount of accumulated dust of the dust collector during cleaning or to dispose the dust within the dust collector.

DETAILED DESCRIPTION

The upright-type electric vacuum cleaner according to an embodiment which embodies the present invention will now be explained on the basis of FIGS. 1 to 14.

Figure 1:
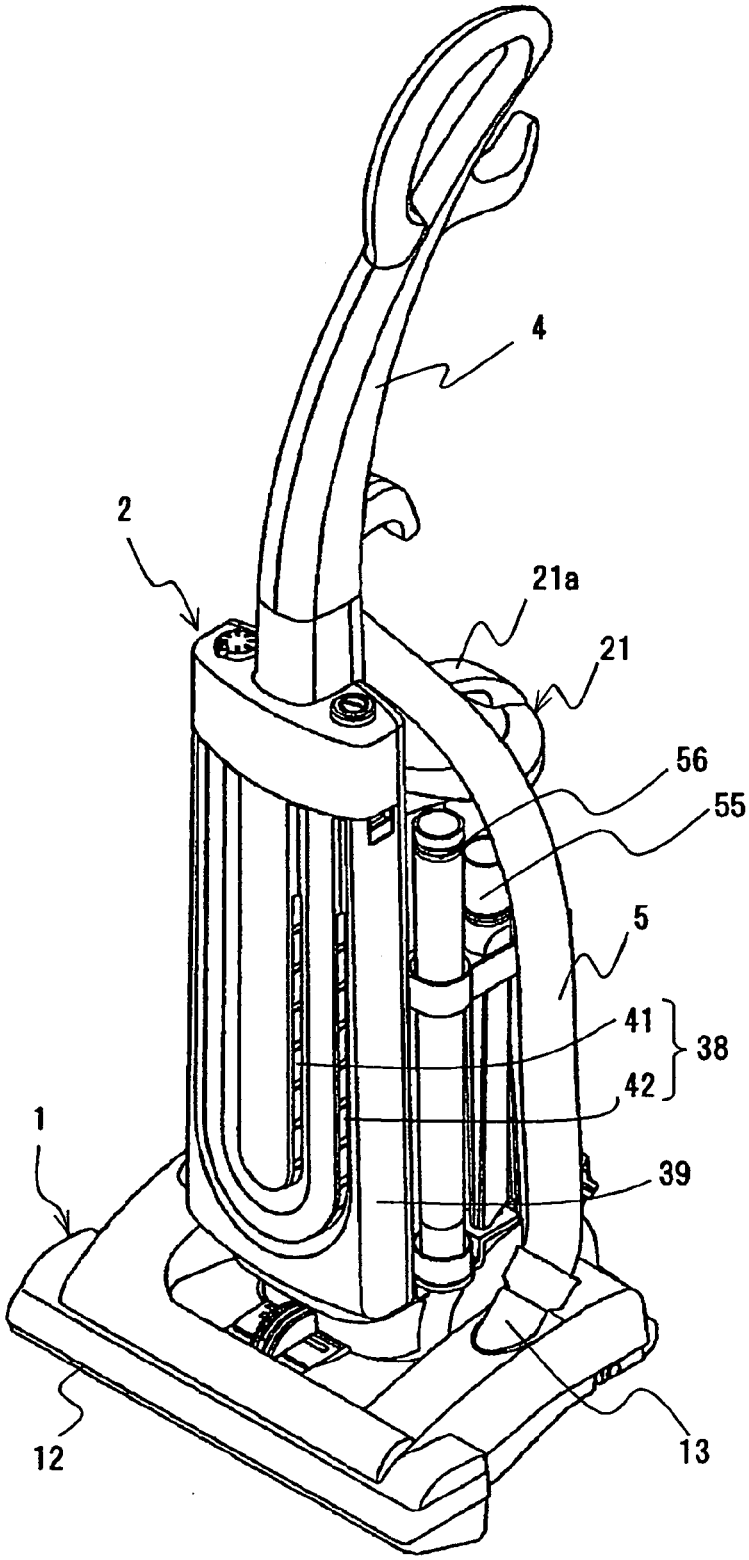
FIG. 1 is a perspective view seen from a frontward side of the upright-type electric vacuum cleaner according to one embodiment of the present invention.
Figure 2:
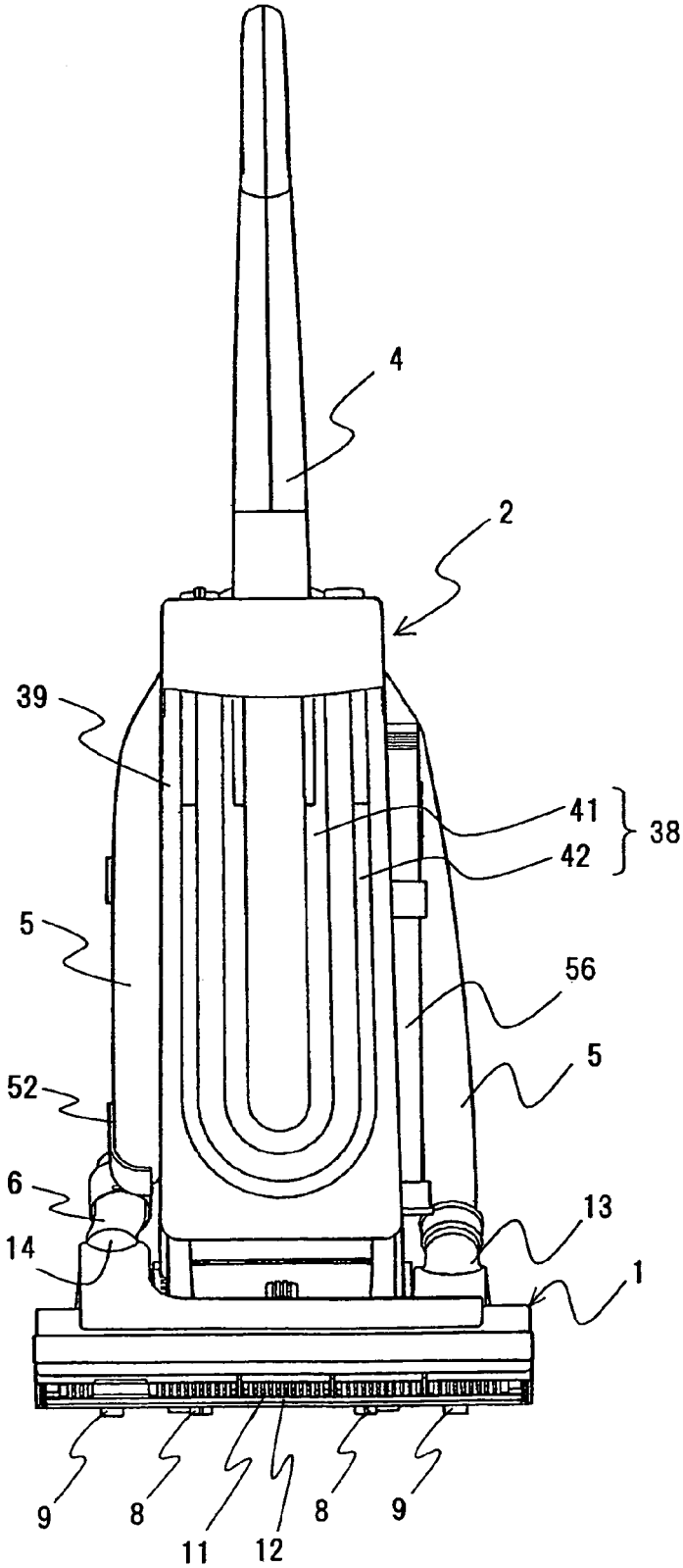
FIG. 2 is a front view of the electric vacuum cleaner.
Figure 3:
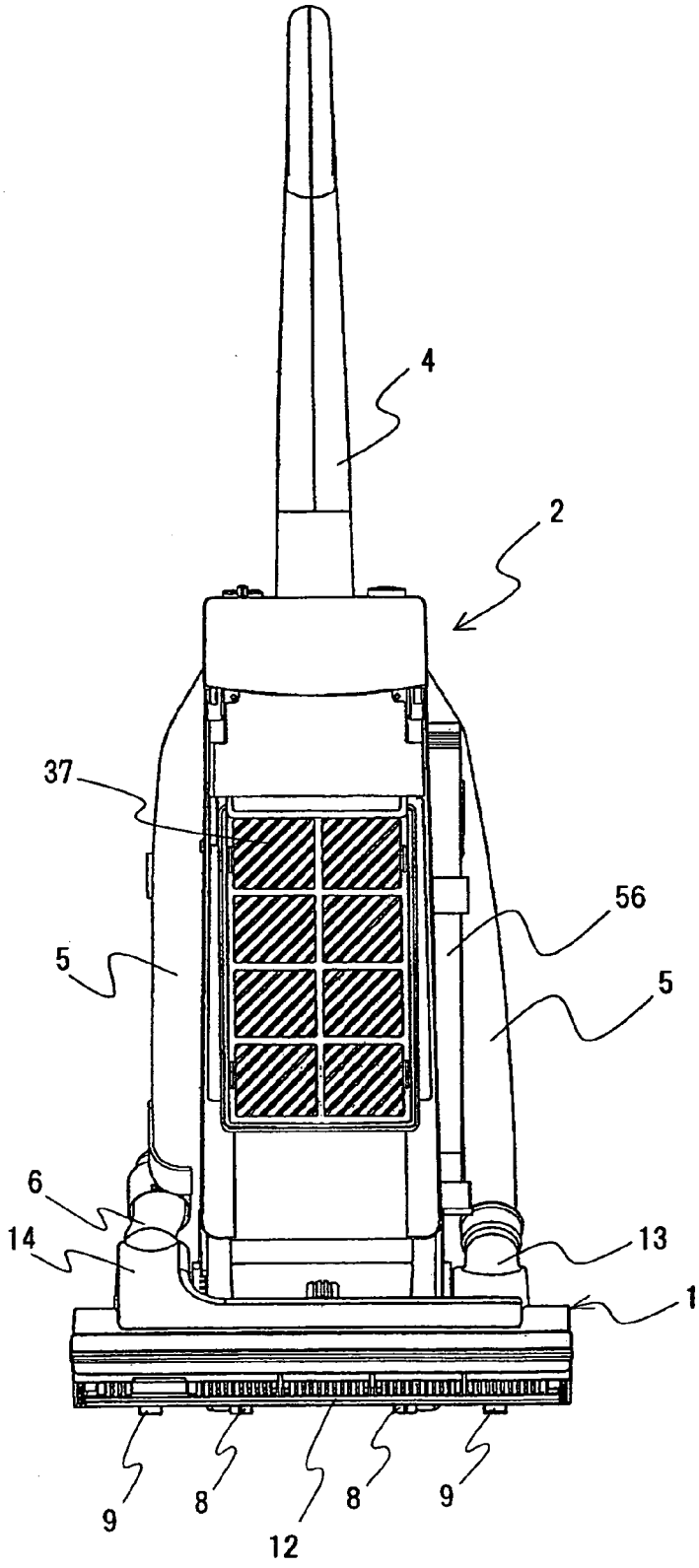
FIG. 3 is a front view of a condition in which a front cover is detached.
Figure 4:
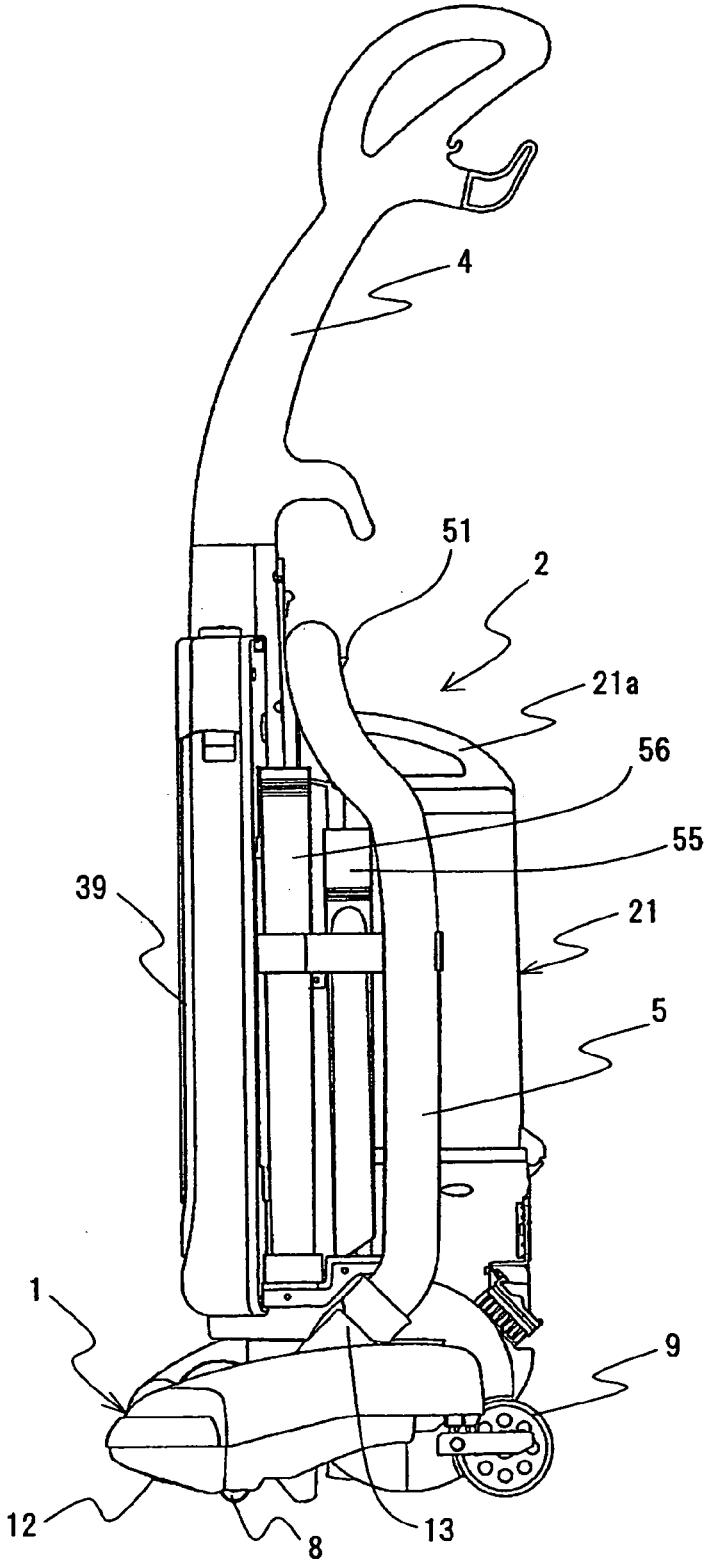
FIG. 4 is a right-hand side view of the electric vacuum cleaner.
Figure 5:
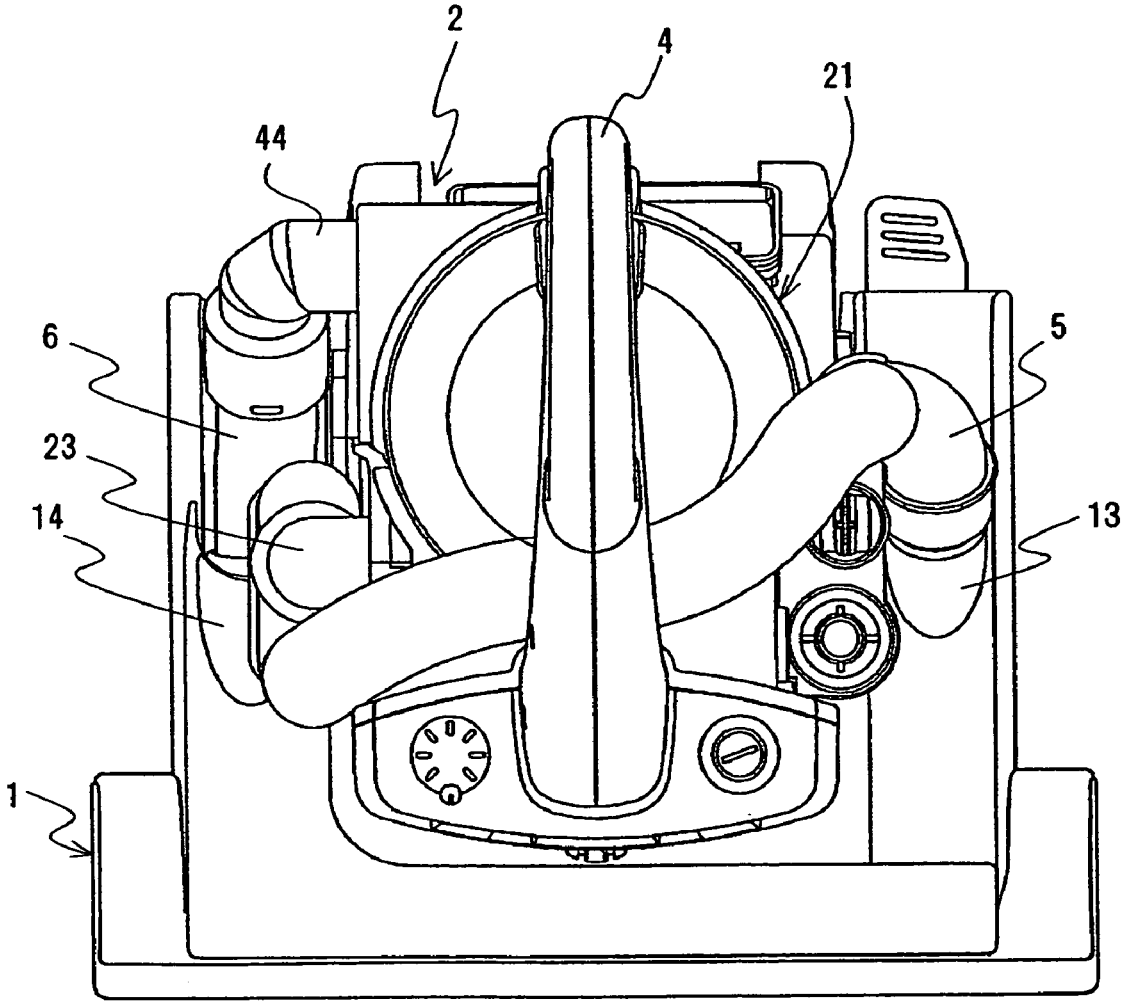
FIG. 5 is a front view of the electric vacuum cleaner.
Figure 6:
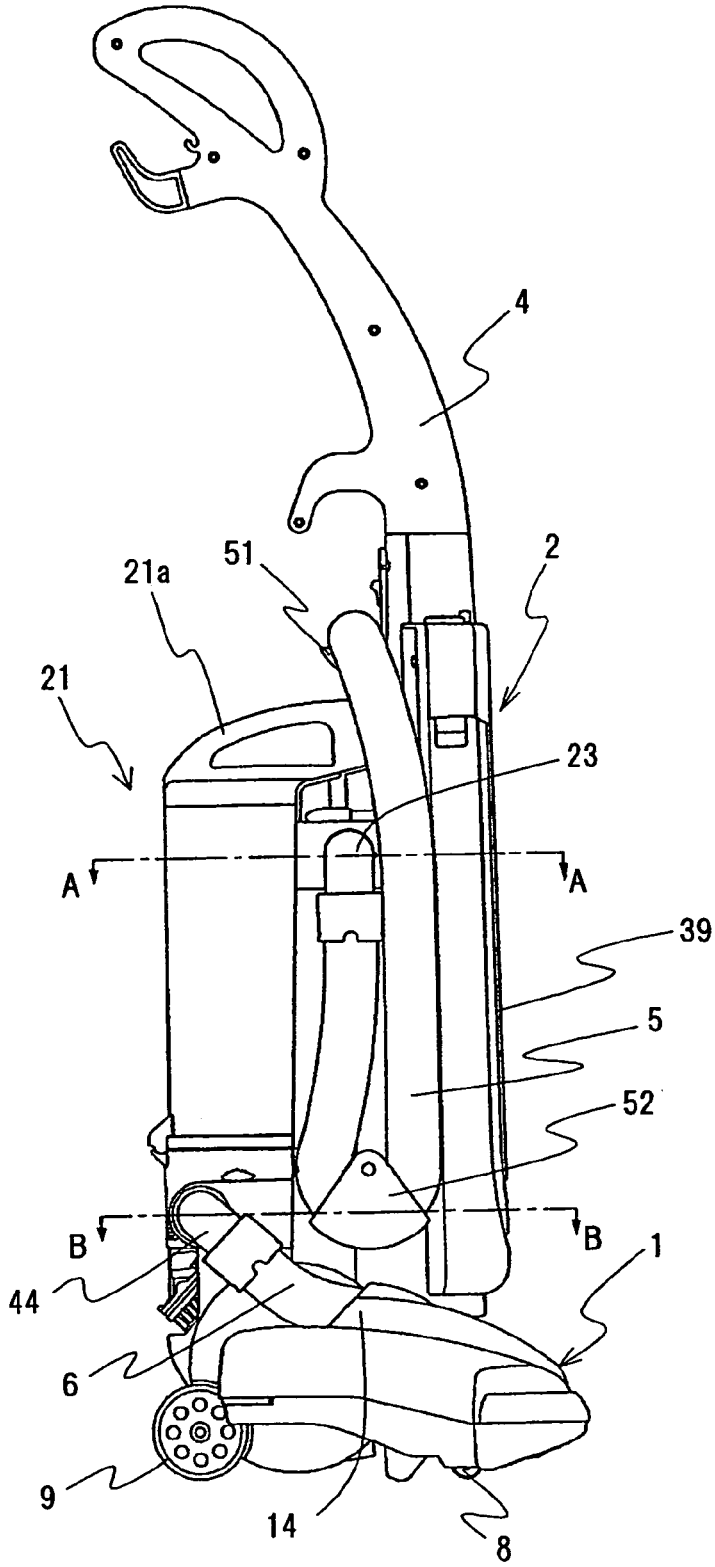
FIG. 6 is a left-hand side view of the electric vacuum cleaner.
Figure 7:
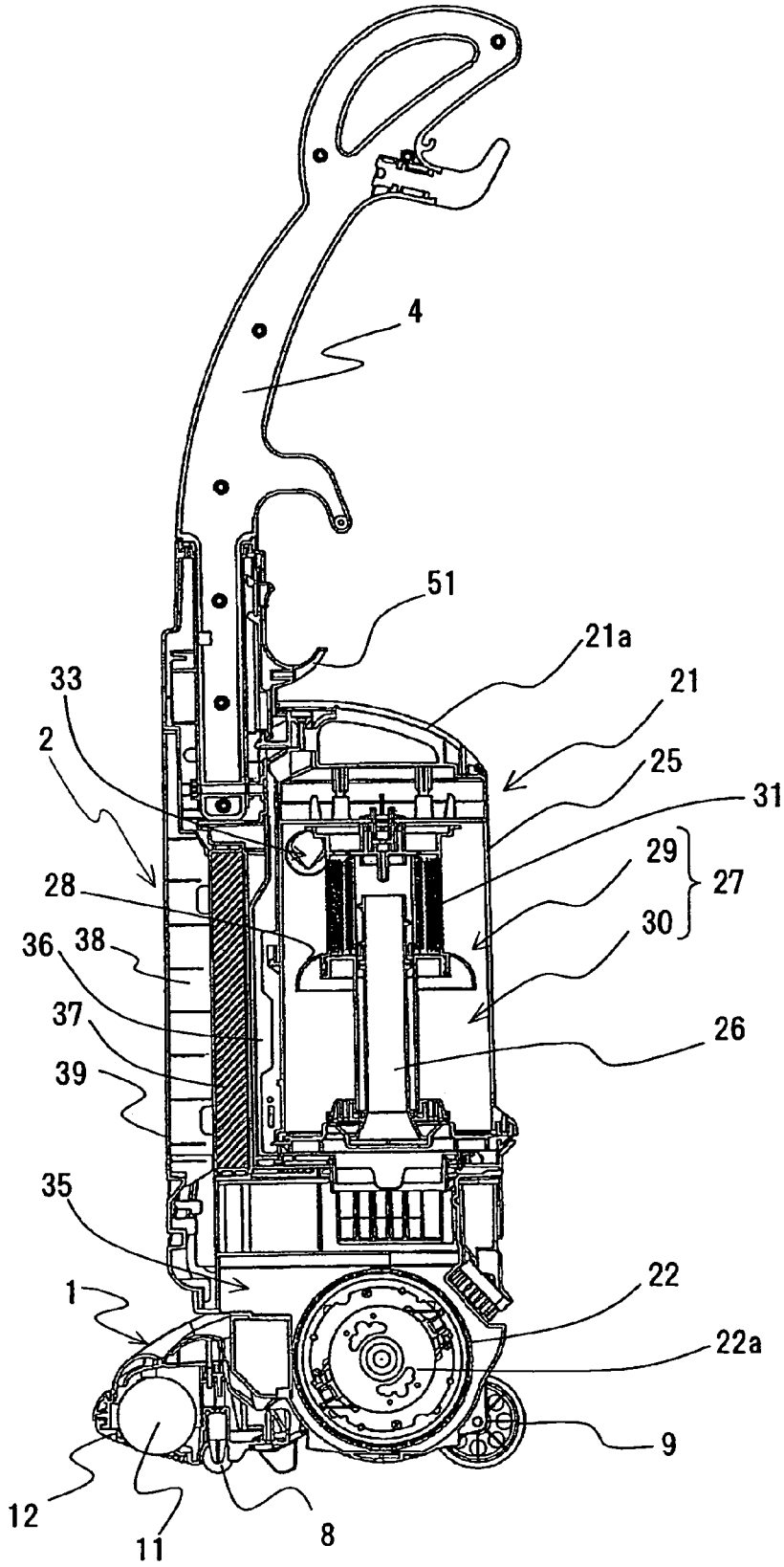
FIG. 7 is a sectional view of a right-hand side of the electric vacuum cleaner.
Figure 8:
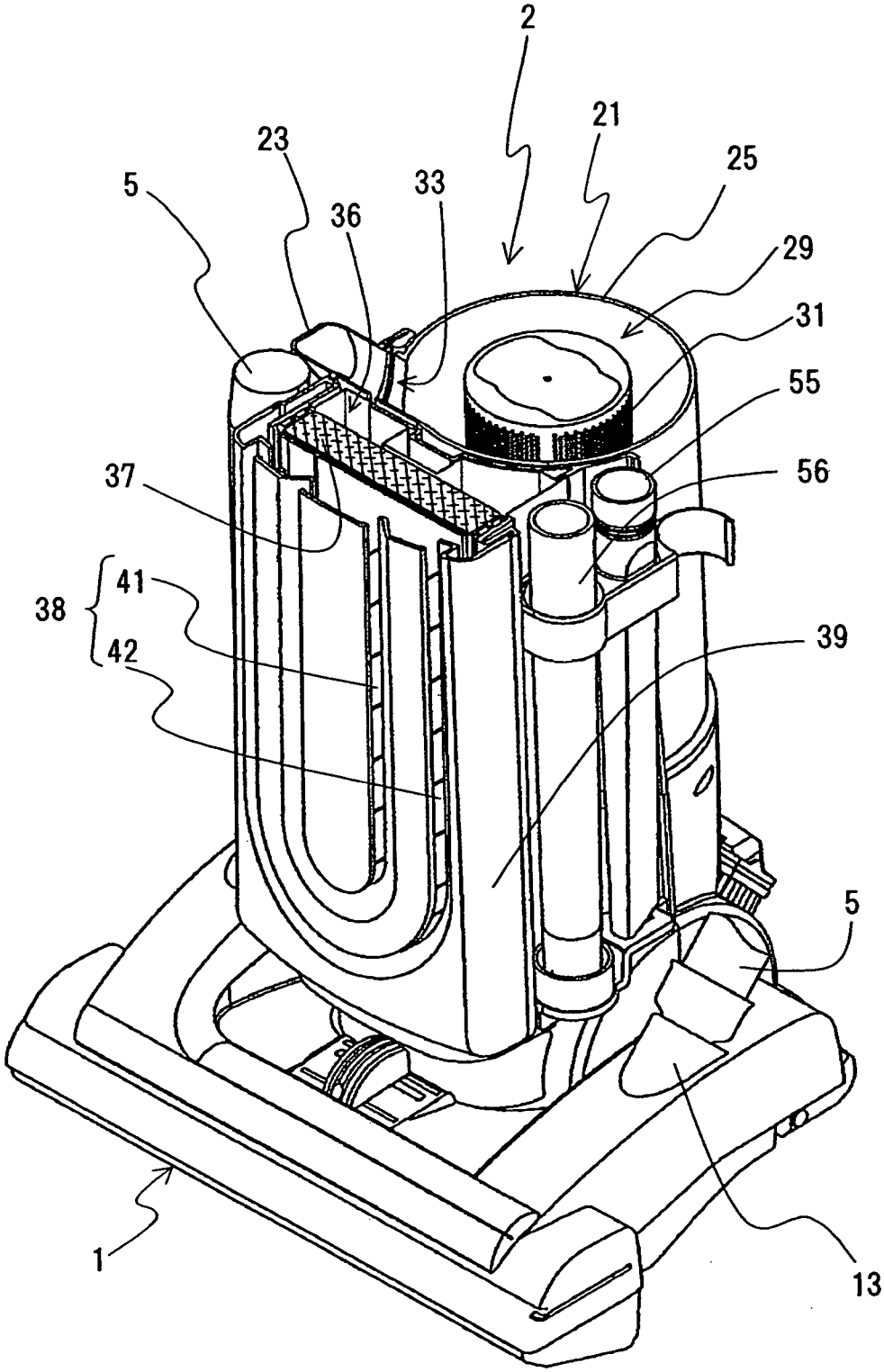
FIG. 8 is a perspective view of section A-A in FIG. 6.
Figure 9:
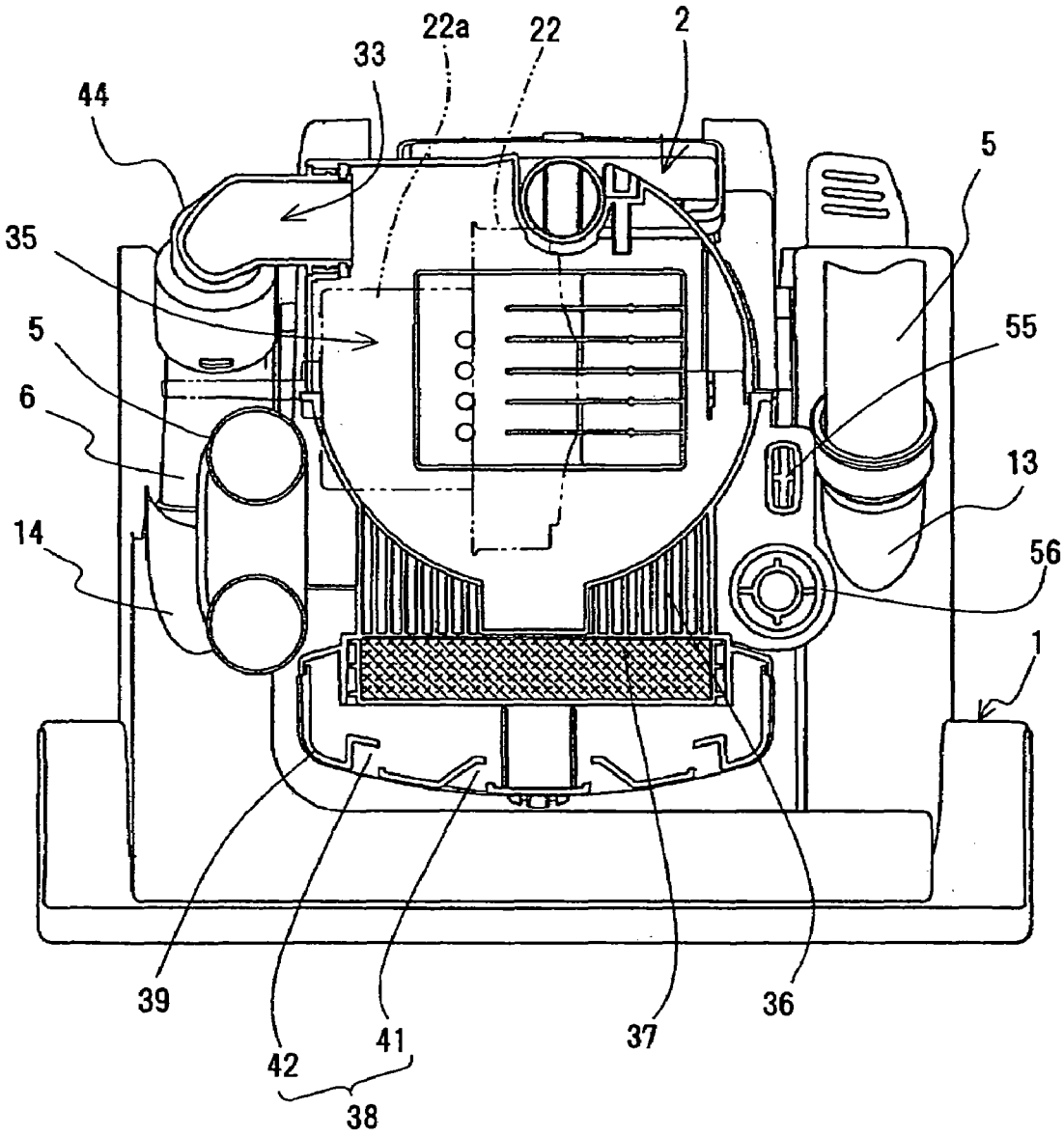
FIG. 9 is a sectional view taken along the line B-B in FIG. 6.
Figure 10:
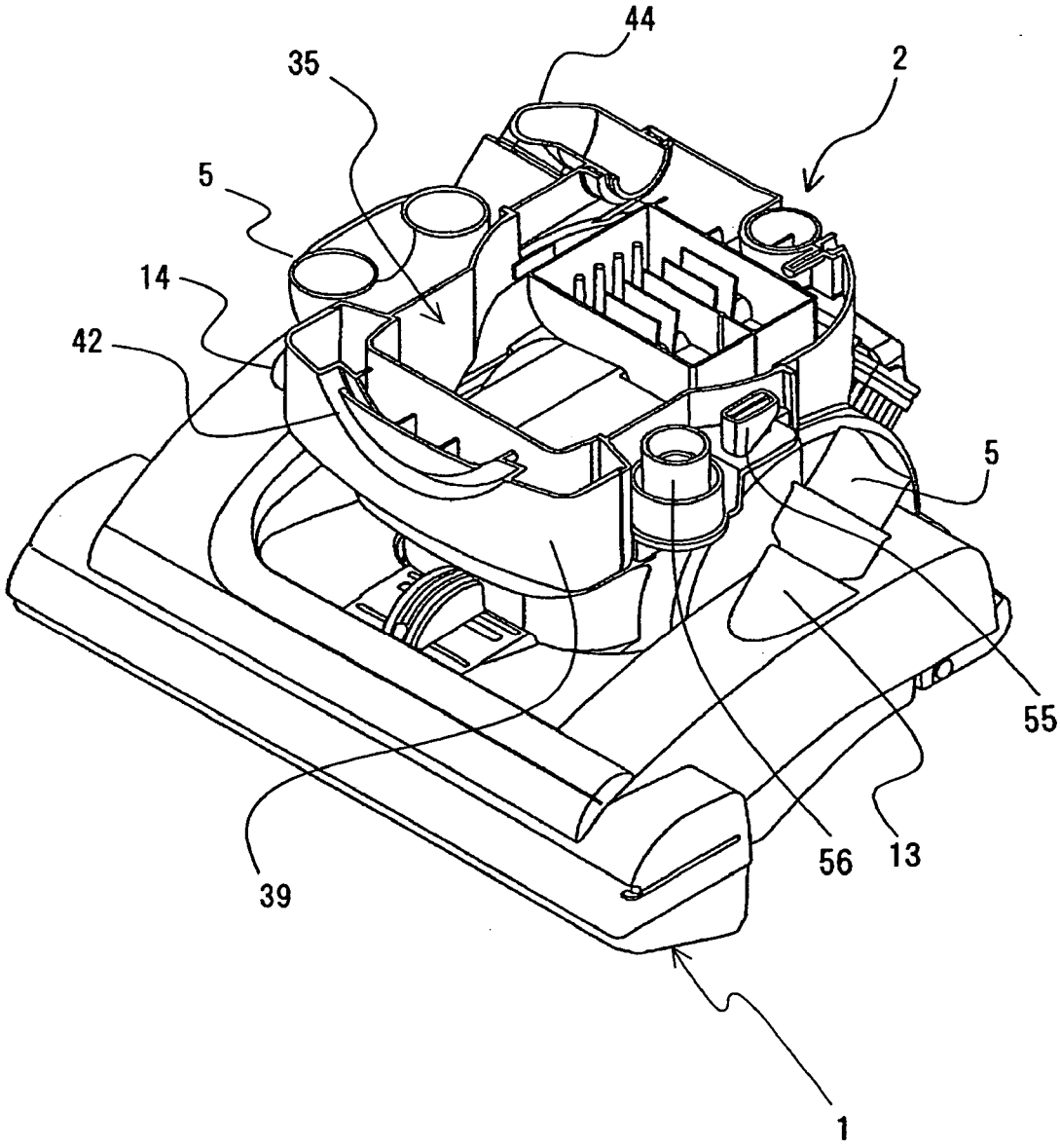
FIG. 10 is a perspective view of section B-B in FIG. 6.
Figure 11:
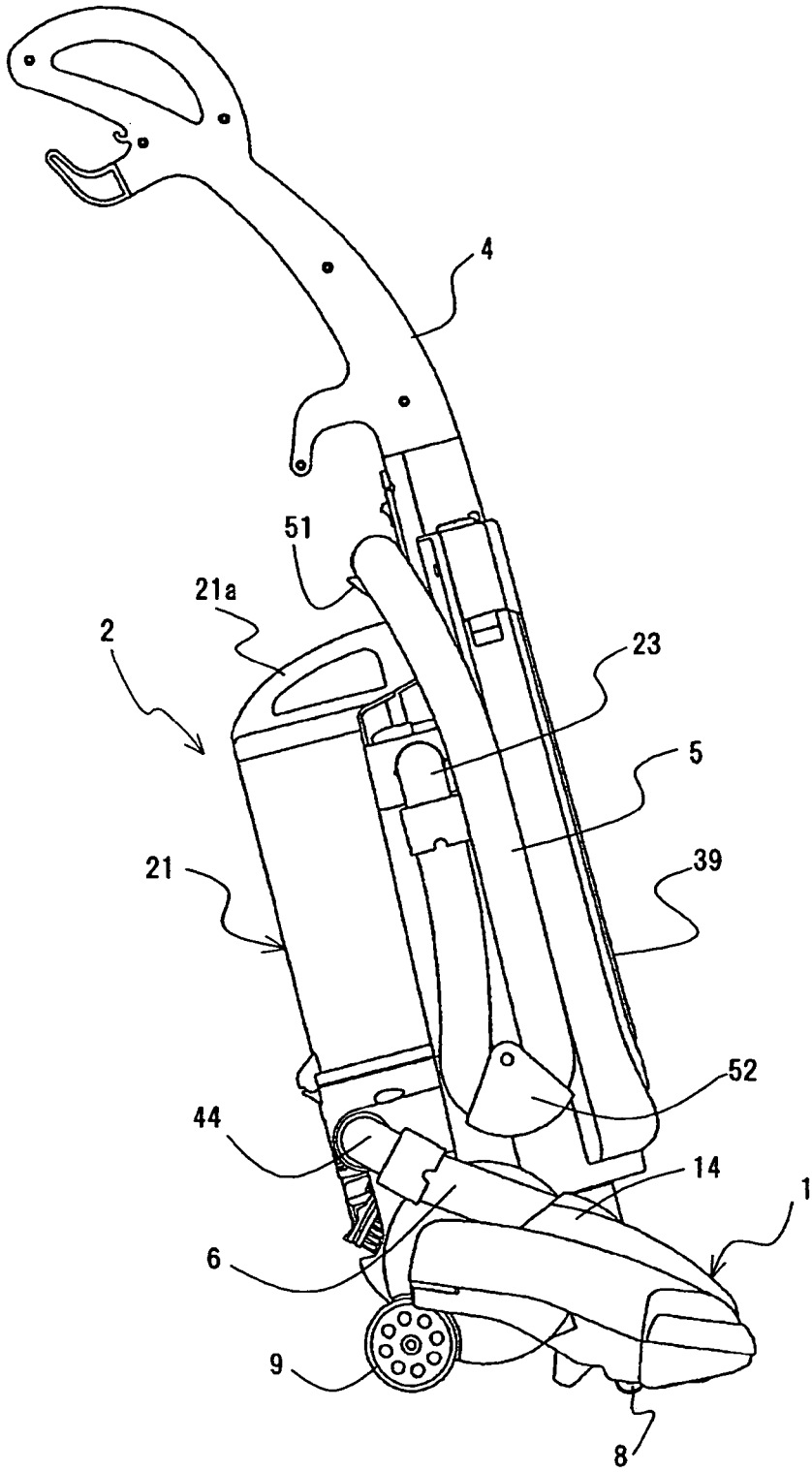
FIG. 11 is a left-hand side view at the time of use of the electric vacuum cleaner, wherein the vacuum cleaner main body is tilted.

The upright-type electric vacuum cleaner according to one embodiment is so arranged that a suction body 1 is provided at a lowermost portion and that a vacuum cleaner main body 2 is attached to the suction body 1 in a freely tilting manner (see FIG. 8). An operating handle 4 is provided at an upper portion of the vacuum cleaner main body 2. In this respect, front wheels 8 are attached to a front floor surface side on a lower portion of the suction body 1, and rear wheels 9 are attached to the suction body 1 on a rear floor surface side.

The suction body 1 is provided with a rotating brush 11 for stirring up dust on the floor, a suction inlet 12 which sucks the dust stirred up by the rotating brush 11 together with air, a first suction hose joint 13 which communicates to the suction inlet 12, a second circulation hose joint 14 which communicates to the suction inlet 12 or the like. In this respect, the first suction hose joint 13 is provided on a rear portion of the suction body 1 on the right-hand side of the vacuum cleaner main body 2 while the second circulation hose joint 14 is provided on a rear portion of the suction body 1 on the left-hand side of the vacuum cleaner main body 2. One end of a suction hose 5 is connected to the first suction hose joint 13 while one end of a circulation hose 6 is connected to the second circulation hose joint 14. Air which has been sucked by the suction body 1 together with dust is sent to a dust collector 21 of the vacuum cleaner main body 2 through the suction hose 5.

The vacuum cleaner main body 2 includes the dust collector 21 on a rearward upper portion thereof, and accumulates therebelow a suction fan 22 and a suction fan motor 22*a* for sucking air through the suction body 1. A second suction hose joint 23 is provided on a left-hand side on a rearward upper portion of the vacuum cleaner main body 2 which communicates to an inlet side of the dust collector 21.

To the second suction hose joint 23, the other end of the above-mentioned suction hose 5, one end of which is connected to the first suction hose joint 13, is connected. The arrangement is accordingly such that air, which is sucked together with dust through the suction inlet 12 of the suction body 1, is sucked through the suction hose 5 to the dust collector 21.

Figure 12:
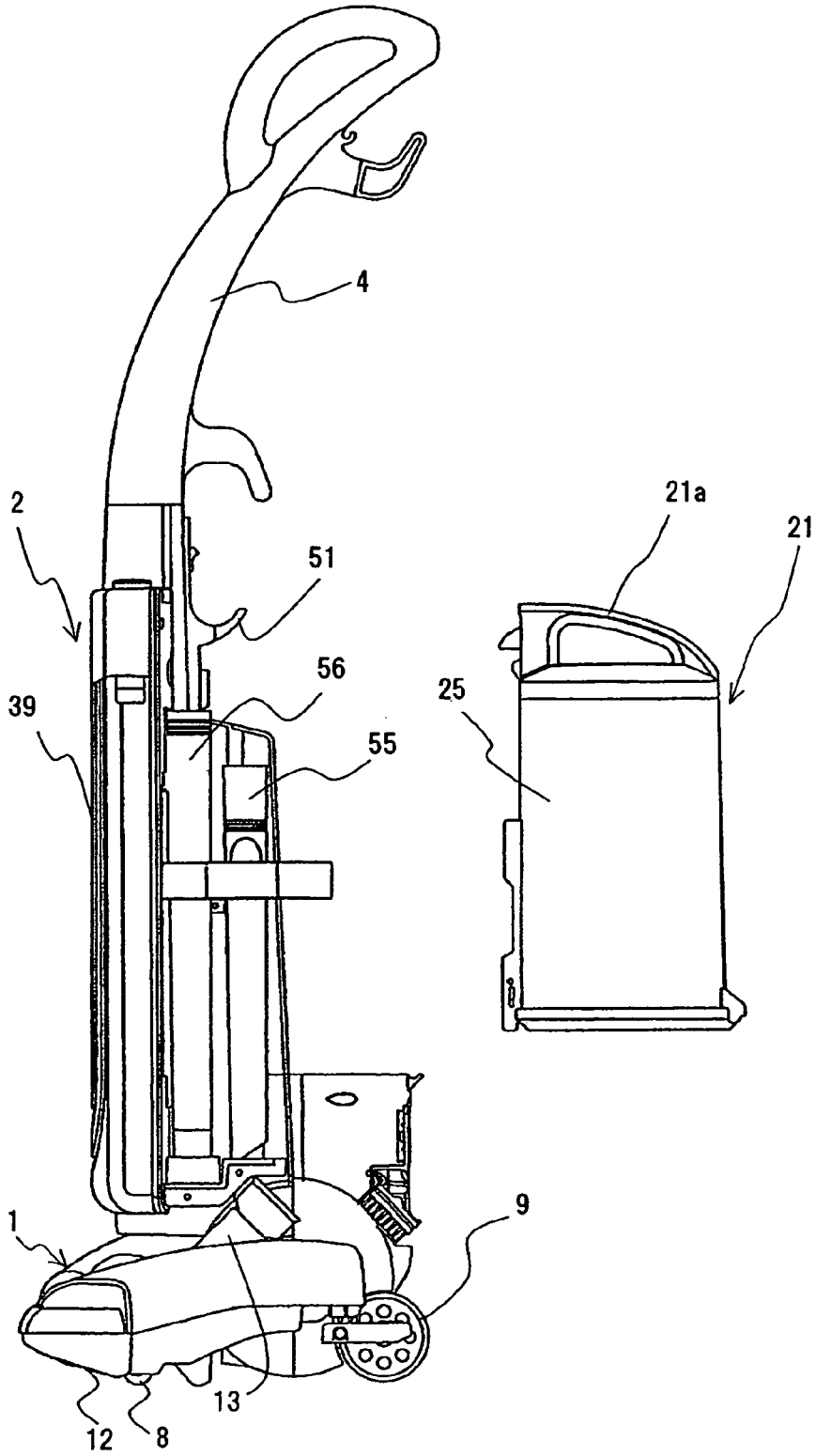
FIG. 12 is a right-hand side view of the electric vacuum cleaner, which illustrates a condition in which the dust collector is detached.

The dust collector 21 is a cyclone dust collector 21. The dust collector 21 is so arranged that a dust collector main body comprises a substantially cylindrical container 25, that it includes a grip 21 a at an upper portion thereof, and that it is attached to the vacuum cleaner main body 2 is a freely attachable and detachable manner on a rearward side thereof (see FIG. 12). An air passage 26 with its upward portion being open is formed in a central portion of the cylindrical container 25. A cylindrical space portion 27 which surrounds the air passage 26 in the interior of the cylindrical container 25 is partitioned into two vertical chambers, namely an upper chamber 29 and a lower chamber 30, through a partitioning member 28 formed at an intermediate height position. A cylindrical filter 31 is formed at a central portion of the upper chamber 29 as to surround the air passage 26. An inlet 33 which communicates to the second suction hose joint 23 opens to the interior thereof, and the arrangement is such that air which is introduced from the inlet 33 to the upper chamber 29 is introduced along an inner wall surface of the cylindrical container 25 to form a spiral flow within the upper chamber 29. In the upper chamber 29, relatively large pieces of dust which are contained in air are removed through this spiral flow of air. The removed dust drops into the lower chamber 30 through a space between the partitioning member 28 and the cylindrical container wall and is accumulated in the lower chamber 30. The dust which has been accumulated in the lower chamber 30 is wasted by releasing a bottom wall of the cylindrical container 25. In this respect, wasting of dust which has been accumulated in the lower chamber 30 is performed by detaching the cylindrical container 25 from the vacuum cleaner main body 2 as illustrated in FIG. 12.

A machine chamber 35 which accumulates therein the suction fan 22 and the suction fan motor 22*a* for sucking air through the suction inlet 12 of the suction body 1 is formed downward of the dust collector 21. An exhaust passage 36 is formed on the entire front surface side of the dust collector 21 of the vacuum cleaner main body 2, wherein an exhaust filter 37 is provided on the front surface of the exhaust passage 36 and an exhaust outlet 38 is formed on the front thereof. The exhaust filter 37 might be of polyurethane foam or a HEPA filter. The exhaust outlet 38 is composed of two large and small slits 41, 42 of U-shaped form which are formed on a front cover 39 of the vacuum cleaner main body 2, wherein exhaustion is performed through the slits 41, 42 towards a side at a front surface. The front cover 39 is provided in a freely attachable and detachable manner. The exhaust filter 37 is provided such that it is freely attachable and detachable when the front cover 39 is in a detached condition. In this respect, the exhaust passage 36, the exhaust filter 37 and the exhaust outlet 38 are of large area without being interfered by the dust collector 21 since the dust collector 21 is disposed on the rear portion of the vacuum cleaner main body 2.

In the machine chamber 35 for accumulating the suction fan 22 and the suction fan motor 22*a*, a space on a blowout side of the suction fan 22 is connected to a first circulation hose joint 44 which circulates a part of the discharged air which has been removed of dust in the dust collector 21 to the suction inlet 12 of the suction body 1. In this respect, the other end of the above-described circulation hose 6, one end of which is connected to the second circulation hose joint 14, is connected to the first circulation hose joint 44. Accordingly, the arrangement is such that a part of the discharged air from the machine chamber 35 is made to circulate to the suction inlet 12 of the suction body 1 through the first circulation hose joint 44, the circulation hose 6, and the second circulation hose joint 14, etc.

As described above, while the suction hose 5 is so arranged that one end thereof is attached to the first suction hose joint 13 which is formed at a right-hand rearward side of the suction body 1 and the other end thereof to the second suction hose joint 23 which is provided at the left-hand upper portion of the vacuum cleaner main body 2, the suction hose 5 is attachable to and detachable from both of the suction hose joints 13, 23. On the other hand, while the circulation hose 6 is so arranged that one end thereof is connected to the first circulation hose joint 44 which is provided at the left-hand upper portion of the vacuum cleaner main body 2 and the other end thereof to the second circulation hose joint 14 which is formed at a left-hand rearward side of the suction body 1, the circulation hose 6 is arranged to be attachable to and detachable from at least the first circulation hose joint 44.

The suction hose 5 is raised upward from the first suction hose joint 13 on the right-hand side of the vacuum cleaner main body 2, and its raised top portion is fixed by being hooked at a hose hook 51, which is formed at a lower end portion of the operating handle 4, from above. The suction hose 5 is further led from the hose hook 51 to the left-hand side of the vacuum cleaner main body 2 and pulled downward, whereupon it is firmly fixed at the vacuum cleaner main body 2 by means of a hose fixing tool 52 which is provided on a left-hand lower end portion of the vacuum cleaner main body 2. The suction hose 5 is further raised upward from the hose fixing tool 52 in a U-shaped manner and connected to the second suction hose joint 23.

The circulation hose 6 is connected, as it is, substantially in a linear manner since the distance between the first circulation hose joint 44 and the second circulation hose joint 14 is short.

The end portion of the suction hose 5 on the second suction hose joint 23 side and the end portion of the circulation hose 6 on the first circulation hose joint 14 side are so arranged that they can be directly connected.

As attachments which are used in this upright-type electric vacuum cleaner, a crevice nozzle 55 and an extension pipe 56 are attached. The crevice nozzle 55 and the extension pipe 56 are attached in a plug-in style to a right-hand side surface of the vacuum cleaner main body 2. These attachments are arranged to be connectable to the end portion of the suction hose 5 on the first suction hose joint 13 side.

In the thus arranged upright-type electric vacuum cleaner, flow of air in case of performing normal cleaning by using the suction body 1 will first be explained. First, air is sucked from the exterior of the suction body 1 so as to suck dust which has been stirred up by the rotating brush 11 at the suction inlet 12 of the suction body 1. A part of discharged air is circulated from the blowout side of the suction fan 22 of the machine chamber 35 to the suction body 1 by passing through the first circulation hose joint 44, the circulation hose 6, and the second circulation hose joint 14 to stir up dust and is sucked.

Air which has been sucked by the suction body 1 is sent to the dust collector 21 upon passing through the first suction hose joint 13, the suction hose 5, and the second suction hose joint 23. Relatively large pieces of dust contained in the air which has been sent to the dust collector 21 is removed in the upper chamber 29 (air whirling chamber) and relatively small pieces of dust are removed by the cylindrical filter 31. Air which has been removed of dust is transferred from the air passage 26 of the dust collector 21 to the machine chamber 35. Air which has been transferred to the machine chamber 35 cools the fan motor 22*a* whereupon a part thereof is discharged to the front surface side of the vacuum cleaner main body 2 upon passing through the exhaust passage 36, the exhaust filter 37 and the exhaust outlet 38 which are formed on the front surface side of the dust collector 21. The remaining air after cooling the fan motor 22*a* is returned to the suction inlet 12 of the suction body 1 through the circulation hose 6. In this manner, normal cleaning through suction using the suction body 1 is performed.

A case in which cleaning is performed through suction by using an attachment without using the suction body 1 will now be explained.

Figure 13:
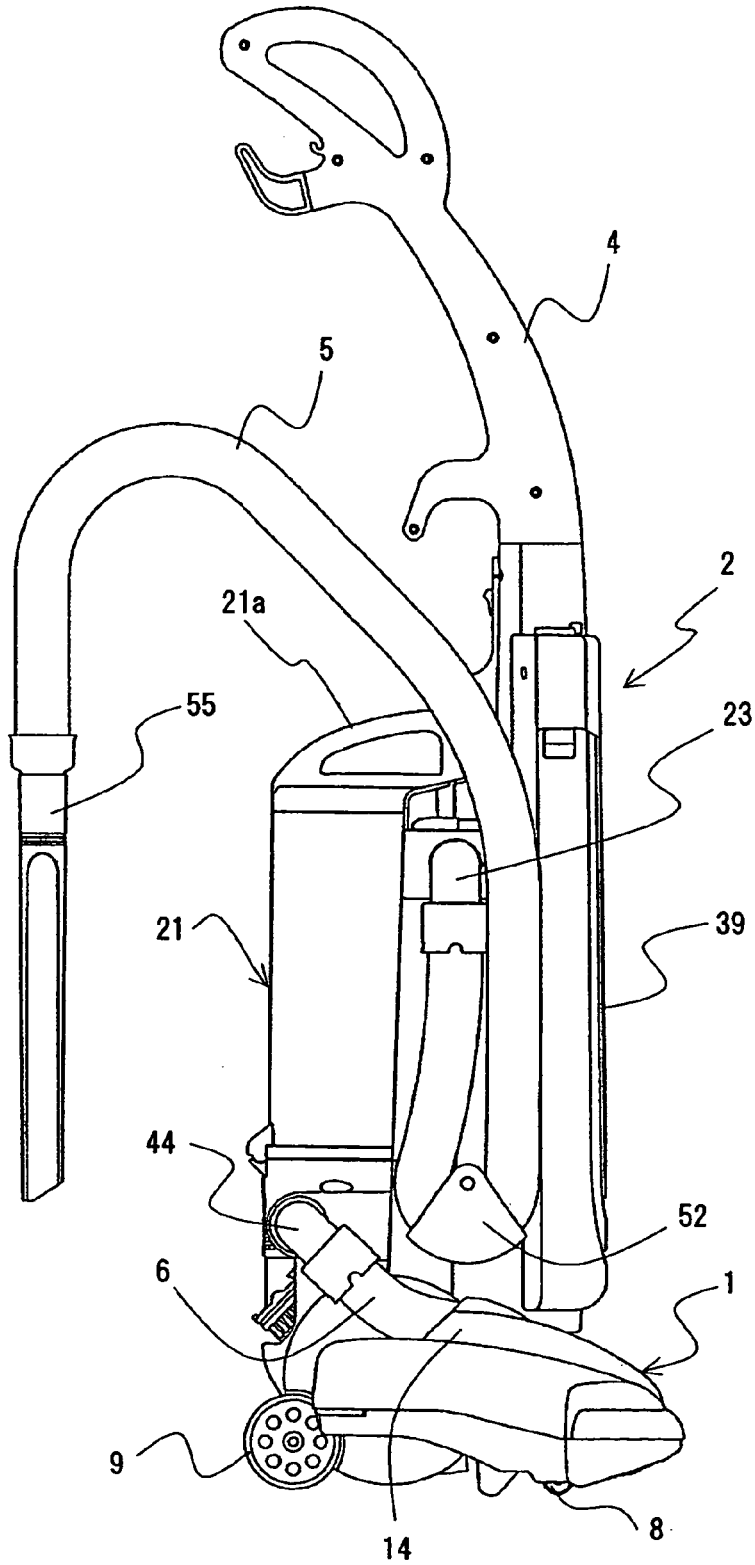
FIG. 13 is a left-hand side view of the electric vacuum cleaner, which illustrates a condition in which cleaning is performed through suction by attaching an attachment to a suction hose.

In this case, connection of the suction hose 5 to the first suction hose joint 13 is detached prior to operating the electric vacuum cleaner. Fixing of the suction hose 5 by the hose hook 51 is similarly detached. A suitable attachment is then attached to the end portion of the detached suction hose 5 on the first suction hose joint 13 side. FIG. 13 illustrates a condition in which the crevice nozzle 55 is attached. As illustrated in this drawing, the suction hose 5 is thus in a condition in which it is firmly fixed to the left-hand lower portion of the vacuum cleaner main body 2 by the hose fixing tool 52 so that a length corresponding to the length from the hose fixing tool 52 to the first suction hose joint 13 will be freely movable.

The suction fan 22 is then driven, the crevice nozzle 55 is moved to a narrow space portion which requires cleaning and dust present at this place is sucked together with air. Air which has been sucked through the crevice nozzle 55 is sent to the dust collector 21. In the dust collector 21, relatively large pieces of dust are removed in the upper chamber 29 and relatively small pieces of dust are removed by the cylindrical filter 31. Air which has been removed of dust is transferred to the machine chamber 35 after removal of dust. Air which has been transferred to the machine chamber 35 cools the fan motor 22*a* whereupon a part of the air is discharged to the front surface side of the vacuum cleaner main body 2 upon passing through the exhaust passage 36, the exhaust filter 37 and the exhaust outlet 38, and the remaining air is discharged into the room through the suction inlet 12 of the suction body 1 upon passing through the first circulation hose joint 44, circulation hose 6 and the second circulation hose joint 14. In this manner, cleaning through suction when employing an attachment is performed.

A case in which cleaning is performed through blower functions by using an attachment without using the suction body 1 will now be explained.

Figure 14:
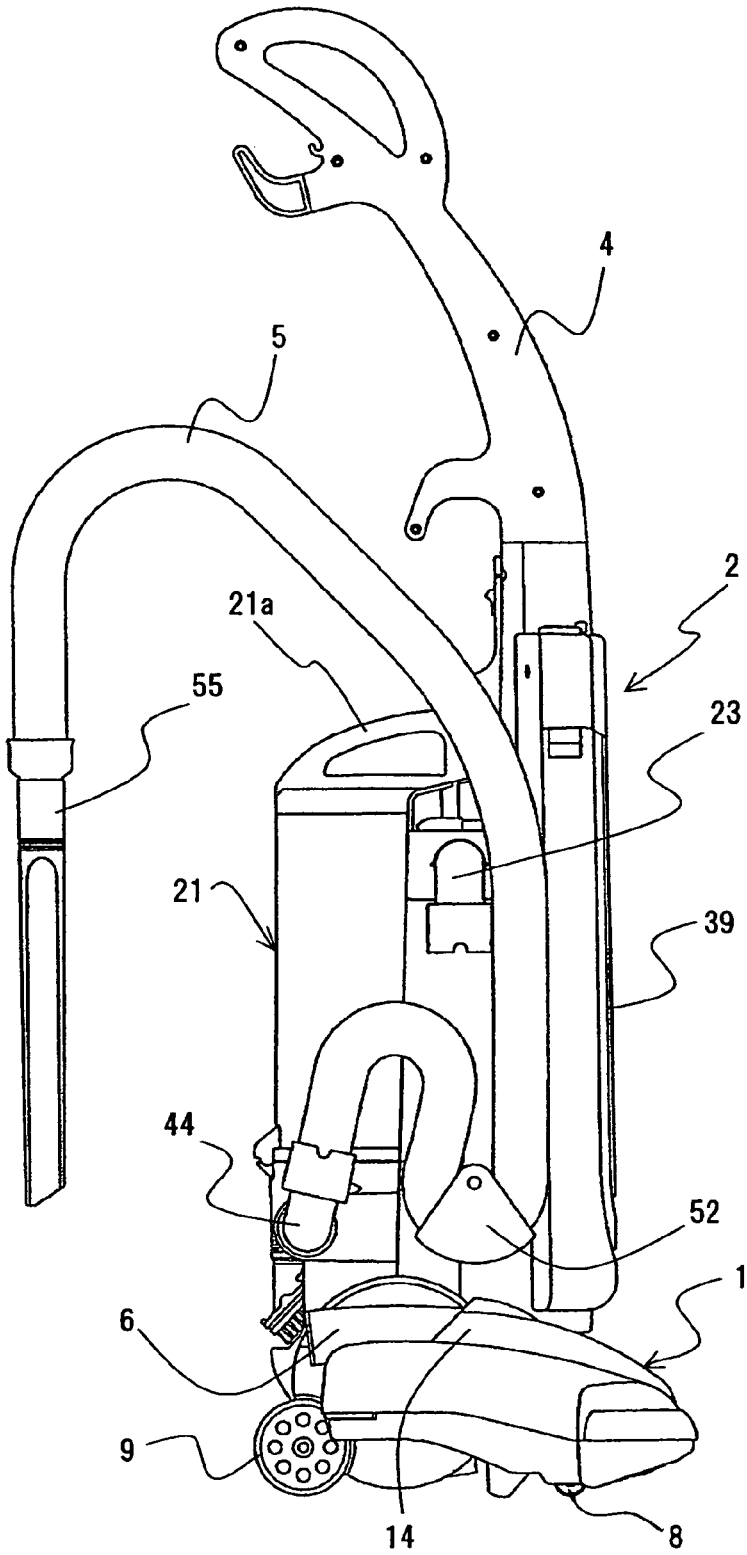
FIG. 14 is a left-hand side view of the electric vacuum cleaner, which illustrates a condition in which cleaning is performed through blowing by attaching an attachment to the suction hose.

In this case, connection of the suction hose 5 to the first suction hose joint 13 and connection to the second suction hose joint 23 are respectively detached prior to operating the electric vacuum cleaner. Fixing of the suction hose 5 by the hose hook 51 is similarly detached. Moreover, connection of the circulation hose 6 to the first circulation hose joint 44 is also detached. A suitable attachment (for instance, the crevice nozzle 55) is then attached to the end portion of the detached suction hose 5 on the first suction hose joint 13 side while the detached end portion of the suction hose 5 on the second suction hose joint 23 side is connected to the second circulation hose joint 44. This condition is illustrated in FIG. 14. In this condition, the suction hose 5 is thus in a condition in which it is firmly fixed to the left-hand lower portion of the vacuum cleaner main body 2 by the hose fixing tool 52 so that a length corresponding to the length from the hose fixing tool 52 to the first suction hose joint 13 will be freely movable.

The suction fan 22 is then driven, and the crevice nozzle 55 is moved to a place which needs to be blown. Air within the room is sucked from the second suction hose joint 23 to which no hose is connected, and sucked air is sent to the dust collector 21. Relatively large pieces of dust contained in air are removed in the upper chamber 29 and relatively small pieces of dust are removed by the cylindrical filter 31. Air which has been removed of dust is transferred to the machine chamber 35. Air which has been transferred to the machine chamber 35 after removal of dust cools the fan motor 22*a* whereupon a part thereof is discharged to the front surface side of the vacuum cleaner main body 2 upon passing through the exhaust passage 36, the exhaust filter 37 and the exhaust outlet 38 while the remaining air is blown through the crevice nozzle 55 to a specified place upon passing the first circulation hose joint 44 and the suction hose 5.

According to the upright-type electric vacuum cleaner of the thus arranged present embodiment, the following effects can be exhibited.

Since the suction hose 5 is connected to between the first suction hose joint 13 which is provided at the suction body 1 to communicate to the suction inlet 12 of the suction body 1 and the second suction hose joint 23 which is provided at the vacuum cleaner main body 2 to communicate the inlet 33 side of the dust collector 21, and since the suction hose 5 is arranged to be attachable to and detachable from the first suction hose joint 13, it is possible to perform cleaning by sucking dust together with air from the attachment by detaching the suction hose 5 from the first suction hose joint 13 and by attaching the attachment to the end portion thereof.

Since the suction hose 5 is respectively connected to the first suction hose joint 13 and a second suction hose joint 23 in a freely attachable and detachable manner, since the circulation hose 6 is connected between the first circulation hose joint 44 provided at the vacuum cleaner main body 2 to communicate to the blowout side of the suction fan 22 in the machine chamber 35 of the vacuum cleaner main body 2 and the second circulation hose joint 14 provided at the suction body 1 to communicate to the suction inlet 12 of the suction body 1, since the end portion of the suction hose 5 on a side which is connected to the second suction hose joint 23 is arranged to be connectable to the first circulation hose joint 44, and since connection between the circulation hose 6 and the first circulation hose joint 44 is arranged in a freely attachable and detachable manner, connection between the suction hose 5 and the circulation hose 6 can be changed as follows. More particularly, it is possible to disconnect the suction hose 5 and the first suction hose joint 13 and to connect an attachment to the end portion on the first suction hose joint 13 side, and also to disconnect the suction hose 5 and the second suction hose joint 23 while also to disconnect the circulation hose 6 and the first circulation hose joint 44 so that the end portion of the suction hose 5 on the second suction hose joint 13 side can be attached to the first circulation hose joint 44. By thus changing the connection of the hoses, it is possible to exhibit a blower function in which air can be blown out from the attachment after removing dust therefrom.

Since the hose fixing tool 52 for fixing an intermediate portion of the suction hose 5 is attached to the vacuum cleaner main body 2 on a downward portion of the second suction hose joint 23 so that the fixing of the suction hose by the fixing tools remains as it is when changing connection between the suction hose 5 and the circulation hose 6, force acting on the vacuum cleaner main body through the suction hose 5 is applied to a downward portion of the vacuum cleaner main body 2 when performing cleaning upon attaching an attachment. Accordingly, a rotation moment which acts to tumble the vacuum cleaner will become smaller, and a resting state of the upright-type electric vacuum cleaner can be stabilized.

Since the first suction hose joint 13 is provided rearward of the suction body 1 on one side of the vacuum cleaner main body 2 while the second suction hose joint 23 is provided on an upward portion of the vacuum cleaner main body 2 on the other side of the vacuum cleaner main body 2, and the hose fixing tool 52 for fixing the intermediate portion of the suction hose 5 is provided at a lower portion of the vacuum cleaner main body 2, the suction hose 5 can be disposed in the following manner. More particularly, the suction hose 5 which is connected to the first suction hose joint 13 is first raised upward whereupon it is pulled downward upon leading the same to the opposite side of the vacuum cleaner main body 2, the pulled down downward portion is fixed to the vacuum cleaner main body 2 by means of the hose fixing tool 52, and by further turning the tip end portion of the suction hose 5 in a U-shaped manner, it can be connected to the second suction hose joint 23 at the upper portion of the vacuum cleaner main body 2. It is accordingly possible to utilize the spaces on both right and left sides of the rearward portion of the vacuum cleaner main body 2 for presentably disposing the suction hose 5 on the rear portion side of the vacuum cleaner main body 2. By leading the suction hose 5 in this manner, the distance between the hose fixing tool 52 and the tip end of the suction hose 5 on the first suction hose joint 13 side can be made long. By disposing the suction hose 5 in this manner, the suction hose 5 can be used over a large area when an attachment is attached thereto, and cleaning using an attachment can be easily performed.

Since the second suction hose joint 23, the first circulation hose joint 44, the second circulation hose joint 14 and the hose fixing tool 52 are attached on the same side of the vacuum cleaner main body 2, it is possible to easily perform connection changing operations of the hoses for exhibiting blower functions. The circulation hose 6 can also be shortened.

Since the first circulation hose joint 44 is formed as a L-shaped joint which is provided on one side of the vacuum cleaner main body 2 and the straight pipe portion which is derived from the side surface of the first circulation hose joint 44 is arranged to be rotatable around its pipe shaft, the direction of the hose connected to the first circulation hose joint 44 can be changed. Accordingly, connection changing operations of the suction hose 5 and the circulation hose 6 can be easily performed.

Since such hose joints are used, the circulation hose 6 will not be forcedly bent also when the vacuum cleaner main body 2 is arranged in a freely tilting manner with respect to the suction body 1, and increases in draft resistance of the circulation hose 6 can be eliminated.

Since the suction hose 5 which is located between the first suction hose joint 13 and the hose connecting tool 52 is fixed by the hose hook 51 provided at a rearward side of the lower end portion of the operating handle 4, leading of the suction hose 5 from the suction body 1 to the hose fixing tool 52 can be fixed at a specified shape. When using an attachment, fixing of the suction hose 5 by the hose hook 51 can be easily released. By releasing fixing of the suction hose 5 by the hose hook 51, it is possible to freely move all portions from the hose fixing tool 52 to the tip end of the suction hose 5.

Since a cyclone style dust collector is used as a dust collector 21, it is possible to dispose the second suction hose joint 23 proximate of the height of the inlet 33 of the cyclone style dust collector to thereby simplify the structure.

Since the dust collector 21 is provided at a rear surface side of an upper portion of the vacuum cleaner main body 2, since the machine chamber accumulating therein the suction fan 22 is provided at a lower portion of the dust collector 21 which comprises a slipstream side of the dust collector 21, and since the first circulation hose joint 44 is provided to communicate to the blowout side of the suction fan of the machine chamber 35 while the second circulation hose joint 14 is provided at a rear portion of the suction body 1 on the same side as the first circulation hose joint 44, a part of the discharged air can be circulated to the suction inlet 12 of the suction body 1 at the shortest distance. It is accordingly possible to reduce the air resistance of this circulation and thus to improve the blowing efficiency.

Since attachments, which are formed to be connectable to the suction hose 5, are attached to the side portion of the vacuum cleaner main body 2, storing and taking off the attachments can be easily performed.

Since the vacuum cleaner main body 2 is so arranged that the dust collector 21 is disposed on the rear portion side while the exhaust outlet 38 is disposed on the front surface side, and particularly on the front surface side of the dust collector 21, it is possible to make the area of the exhaust outlet 38 large without being interfered by the dust collector 21. As a result, the air resistance within the exhaust passage can be reduced, and the suction performance of the electric vacuum cleaner can be improved. Since the wind velocity of exhaustion from the exhaust outlet 38 can be made small, occasion at which a person residing in the room will feel uncomfortable through exhaust wind or at which dust within the room is stirred up by the exhaust wind will be reduced.

Since the vacuum cleaner main body 2 is further so arranged that the exhaust filter 37 is provided at a position inside of the exhaust outlet 38 at a position at which it opposes the exhaust outlet 38, the area of the exhaust filter 37 can be made large. Accordingly, stains per each unit area of the exhaust filter 37 can be reduced, and the frequency of cleaning or exchanging the exhaust filter 37 can be reduced.

Since the front cover 39 is attached to the front surface of the vacuum cleaner main body 2 in a freely attachable and detachable manner, since the exhaust outlet 38 is formed on the front cover 39, and since the exhaust filter 37 is attached such that it can be freely attached to and detached from the front surface when the front cover 39 is detached, detaching the exhaust filter 37 for cleaning and exchanging operations thereof can be easily performed.

Since the dust collector 21 is disposed on the rear side of the operating handle 4 attached to the upper portion of the vacuum cleaner main body 2 and also in a freely attachable and detachable manner to and from the vacuum cleaner main body 2, it will be easy to check the amount of accumulated dust of the dust collector 21 during cleaning or to dispose the dust within the dust collector 21.

In this respect, the present invention is characterized in that it comprises a vacuum cleaner main body 2 including at least a dust collector 21 and an exhaust outlet 38, and a suction body 1 which is provided at a lower front of the vacuum cleaner main body 2, wherein the dust collector 21 is disposed on a rear portion side of the vacuum cleaner main body 2 and wherein the exhaust outlet 38 is disposed on a front surface side of the dust collector 21, and it is not to be limited to the upright-type electric vacuum cleaner as described in the above embodiment.

For instance, while the suction hose 5 is connected to the suction body 1 and the dust collector 21 in a freely attachable and detachable manner in the upright-type electric vacuum cleaner according to the above embodiment, the present invention might also be embodied by an upright type electric vacuum cleaner in which the suction hose 5 is fixedly connected to the suction body 1 and the dust collector 21. The present invention might also be embodied by an upright-type electric vacuum cleaner in which the suction body 1 and the dust collector 21 are connected through internal structures of the vacuum cleaner main body 2 and the suction body 1 without using the suction hose 5.

Similarly, while the circulation hose 6 is connected to the blowout side of the suction fan 22 of the vacuum cleaner main body 2 and the suction body 1 in a freely attachable and detachable manner in the upright-type electric vacuum cleaner according to the present embodiment, the present invention might also be embodied by an upright-type electric vacuum cleaner in which the circulation hose 6 is fixedly connected to the blowout side of the suction fan 22 of the vacuum cleaner main body 2 and the suction body 1. The present invention might also be embodied by an upright-type electric vacuum cleaner in which the blowout side of the suction fan 22 and the suction body 1 are connected through internal structures of the vacuum cleaner main body 2 and the suction body 1 without using the circulation hose 6.

As explained so far, since the present invention comprises a vacuum cleaner main body including at least a dust collector and an exhaust outlet and a suction body provided at a lower front of the vacuum main body, wherein the dust collector is disposed on a rear side of the vacuum cleaner main body and wherein the exhaust outlet is disposed on a front surface side of the dust collector, the area of the exhaust outlet can be made large without being interfered by the dust collector. As a result, it is possible to reduce the air resistance of the exhaust passage and to improve the suction performance of the electric vacuum cleaner. Since the wind velocity of exhaustion from the exhaust outlet can be made small, it is possible to reduce discomfort of a person residing in the room through exhaust wind or stirring up of dust within the room by the exhaust wind.

What is claimed is:

1. An upright-type electric vacuum cleaner comprising a vacuum cleaner main body including at least a detachable dust collector and an exhaust outlet, a suction body having a suction inlet provided at a lower front of the vacuum main body, and a suction fan for sucking dust and air through the suction inlet to the dust collector, wherein the dust collector is disposed on a rearward side of the vacuum cleaner, said dust collector can be attached to and detached from other parts of the vacuum cleaner main body without first removing any other part of the vacuum cleaner, an exhaust passage, through which exhaust air of the suction fan passes, is formed substantially on an entire front surface side of the dust collector, and the exhaust outlet is formed on the front surface side of the exhaust passage.

2. The upright-type electric vacuum cleaner of claim 1, wherein an exhaust filter is provided inside of the exhaust outlet at a position at which the exhaust filter opposes the exhaust outlet.

3. The upright-type electric vacuum cleaner of claim 2, wherein the vacuum cleaner main body includes a front cover attached to a front surface of the vacuum cleaner main body in a freely attachable and detachable manner in which the exhaust outlet is formed on the front cover, and wherein the exhaust filter is attached such that the exhaust filter can be freely attached to or detached from the front surface when the front cover is detached.

4. The upright-type electric vacuum cleaner of claim 1, wherein the dust collector is disposed on a rear side of an operating handle attached to an upper portion of the vacuum cleaner main body.

5. The upright-type electric vacuum cleaner of claim 2, wherein the dust collector is disposed on a rear side of an operating handle attached to an upper portion of the vacuum cleaner main body.

6. The upright-type electric vacuum cleaner of claim 3, wherein the dust collector is disposed on a rear side of an operating handle attached to an upper portion of the vacuum cleaner main body.

7. The upright-type electric vacuum cleaner of claim 1, wherein the suction body is arranged in such a way that a part of the exhaust air from the dust collector is circulated to the suction inlet of the suction body through a first circulation hose joint, a circulation hose and a second circulation hose joint for stirring up the dust.

* * * * *